US007513802B2

(12) United States Patent
Tufano, Sr. et al.

(10) Patent No.: US 7,513,802 B2
(45) Date of Patent: Apr. 7, 2009

(54) LAMP BASE ADAPTER

(75) Inventors: Anthony Tufano, Sr., North Massapequa, NY (US); Paul Endres, Plainview, NY (US); Anil B. Deshmukh, Commack, NY (US); Rick Wyke, Valdese, NC (US)

(73) Assignee: Leviton Manufacturing Company, Inc., Little Neck, NY (US)

( * ) Notice: Subject to any disclaimer, the term of this patent is extended or adjusted under 35 U.S.C. 154(b) by 680 days.

(21) Appl. No.: 11/079,341

(22) Filed: Mar. 15, 2005

(65) Prior Publication Data

US 2005/0231964 A1 Oct. 20, 2005

Related U.S. Application Data

(60) Provisional application No. 60/555,621, filed on Mar. 23, 2004.

(51) Int. Cl.
*H01R 27/02* (2006.01)

(52) U.S. Cl. ..... 439/642; 362/458; 439/644

(58) Field of Classification Search ..... 439/642, 439/644; 362/458
See application file for complete search history.

(56) References Cited

U.S. PATENT DOCUMENTS 3,433,967 A * 3/1969 Bernheim ..... 250/239
4,183,604 A * 1/1980 Tjornhom, Sr. ..... 439/300
4,440,467 A * 4/1984 Vologni et al. ..... 439/642
4,565,419 A * 1/1986 Johnson et al. ..... 439/641
5,121,287 A * 6/1992 Lee ..... 361/600
5,382,181 A * 1/1995 Ortiz ..... 439/628
5,731,663 A * 3/1998 Davis ..... 315/194
5,989,070 A * 11/1999 Al-Turki ..... 439/644
6,113,433 A * 9/2000 Al-Turki ..... 439/639
6,162,100 A * 12/2000 Al-Turki ..... 439/644

* cited by examiner

*Primary Examiner*—Michael C Zarroli
(74) *Attorney, Agent, or Firm*—Collard & Roe, P.C.

(57) ABSTRACT

A lamp adapter can adapter a mogul base lamp holder to accept a medium base lamp. The lamp adapter can accommodate only open fixture rated lamps. An open end of the lamp adapter into which a lamp is inserted has an elongated flange which allows only an open fixture rated lamp having a medium base to be completely threaded into the adapter and make electrical contact with a threaded metal sleeve and central button contact of the lamp holder. The geometry of the elongated flange prevents the threading of a closed fixture rated lamp into the adapter by taking advantage of the physical differences between the open and closed fixture rated lamps.

10 Claims, 4 Drawing Sheets

LAMP BASE ADAPTER

This application claims the benefit of the filing date of a provisional application having Ser. No. 60/555,621 which was filed on Mar. 23, 2004.

BACKGROUND

1. Field

This invention relates to an electrical adapter for an open fixture rated lamp that is unsuitable for a closed fixture rated lamp.

2. Background of Related Art

Metal halide lamps may include a relatively centrally located arc tube situated within the confines of an outer glass bulb. These arc tubes may be made of quartz and operate at high temperatures and high pressures with respect to ordinary incandescent lamps. Under certain conditions (e.g., at the end of the lamp's life) a system failure or internal factors may result in a safety hazard being created, whereby a violent shattering of the arc tube will send hot glass and lamp parts into contact with the bulb glass which, in turn, can break, releasing the hot glass and lamp parts into the surrounding environment. Under such conditions, there is an obvious risk of severe personal injury, fire and/or property damage.

For this reason, normally such conventional metal halide lamps are supported within what may be referred to as "enclosed" fixtures whose structure is designed to contain violently released hot glass and lamps parts. A cover lens may be used in such fixtures. In addition, significant reductions in such potential violent failures can be achieved by relamping before the rated end of the life of the lamp. Another conventional manner in which such potential violent failures is reduced includes the user periodically turning off the lamp to permit lamp cooling, so that upon relighting, a non-violent or less violent lamp failure is facilitated. An open fixture rated lamp is a high pressure metal halide lamp which, at the end of its life, will not explode and emit hazardous shards of glass. Lamps that are open fixture rated may be suitable for operation in open fixture designs. These types of lamps may feature ultraviolet (UV) protective quartz and a secondary shroud surrounding the arc tube to prevent the scatter of glass in the event of a rupture. Open fixture rated metal halide lamps offer significant advantages for users over closed fixture rated lamps, which can shatter at the end of their life. The open fixture rated lamps can broaden luminaire options by (1) eliminating the need for cover lenses, (2) making lamp replacement easier and (3) removing a source of dirt accumulation that reduces light output. Nevertheless, the major reason to select shrouded, open rated lamps is to protect people and property.

In the past, many mogul base metal halide lamps were enclosed rated only. Newer arc chambers now have a smaller size. The small size of the newer arc chambers can make it possible to add a protective, heavy quartz shroud within the lamp body. The heavy shroud provides containment of hot, inner arc particles should a non-passive lamp failure occur. These lamps can be rated for operation in open fixtures. Enclosing a lamp in a fixture for safety reasons can be eliminated. Operating the metal halide lamp in an open fixture also can help eliminate the reduced lighting efficiency and potentially higher operating temperatures brought on by protective fixture enclosures.

An open fixture rated lamp may be visually distinguished from a closed rated fixture lamp. A center contact button design of the lamp's base mates only to an open rated socket used in an open fixture. This ensures continued safe operation of the open fixture by preventing lamping or relamping with a lamp of another type.

The advent of the open fixture rated metal halide lamps has provided an opportunity for users to use those lamps in existing open fixtures. These existing open fixtures may have lamp sockets known as "mogul" threaded sockets. Both the open and closed rated metal halide lamps can have a medium lamp base, which will not thread into the mogul socket.

SUMMARY OF THE DISCLOSURE

Techniques and methods are disclosed for an adapter to adapt a mogul base lamp holder to mate electrically only with an open fixture rated medium base lamp and to prevent mating with a closed fixture rated medium base lamp. The adapter takes advantage of geometrical differences between open fixture rated lamps and closed fixture rated lamps.

A lamp holder adapter includes a lamp base adapter to mate with a medium base lamp and to thread into a mogul base lamp holder. A flange extends from a first end of the lamp base adapter a length sufficient to prevent the lamp base adapter from mating with a closed fixture rated lamp.

The lamp holder adapter can have an open first end and a closed second end. The bore can have a first section at the open first end. A first threaded conductive sleeve can be mounted in the hollow bore and a second threaded conductive sleeve on an outside surface of the lamp base adapter.

Some of the implementations of the disclosed techniques may include one or more of the following advantages. The adapter can enable an existing open fixture lamp holder that accepts a mogul base lamp to be relamped with an open fixture rated medium base lamp. The adapter can prevent a user from installing a closed fixture rated lamp in an open fixture lamp holder.

The above-stated and other advantages of the invention will become apparent from the following detailed description when taken with the accompanying drawing. It will be understood, however, that the drawing is for the purpose of illustration and is not to be construed as defining the scope or limits of the invention, reference being had for the latter purpose to the claims appended hereto.

BRIEF DESCRIPTION OF THE DRAWINGS

Preferred embodiments of the present application are described herein with reference to the drawings in which similar elements are given similar reference characters, wherein.

DETAILED DESCRIPTION

The disclosed lamp adapter can accommodate only open fixture rated lamps having a medium base. The open end of the lamp adapter into which a lamp is inserted has an elongated flange which allows only an open fixture rated lamp having a medium base to be completely threaded into the adapter and make electrical contact with a threaded metal sleeve and central button contact of the lamp holder. The geometry of the elongated flange prevents the threading of a closed fixture rated lamp into the adapter by taking advantage of the physical differences between an open and closed fixture rated lamps.

Figure 1:
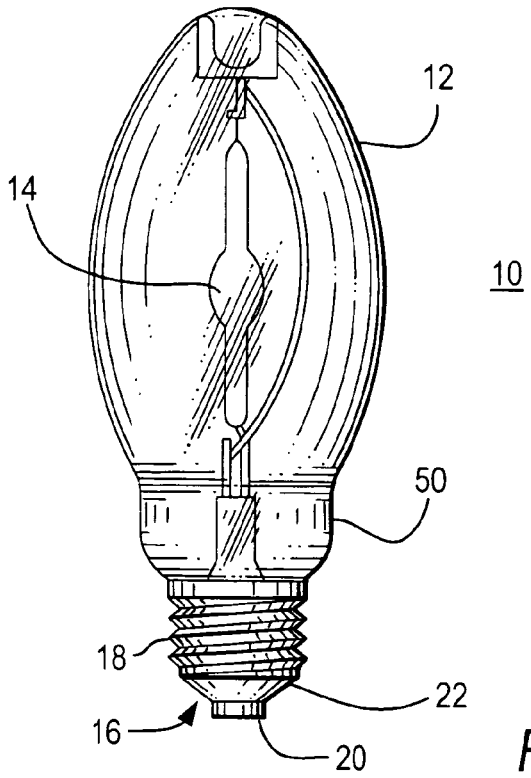
FIG. 1 PRIOR ART
FIG. 1 is an illustration of a closed fixture rated lamp.

FIG. 1 is an illustration of a metal halide lamp 10 intended for use in a "closed" fixture. Lamp 10 can have a glass bulb 12 within which can be placed a quartz arc tube 14. Bulb 12 also can have a metal screw base 16 with a lower portion containing metal base threads 18. In an implementation, the base threads are American Standard medium threads. The base 16 can be fabricated from any conductive metal such as copper or a copper alloy. A relatively metal button 20, often termed a solder or button, also made of metal can be mechanically but not electrically joined to the end of base 16 by an insulator 22, such as a non-conductive ceramic as is well known in the art. The base 16 is connected to one side of arc tube 14 while contact 20 is connected to the other. A lower portion 50 of the bulb 12 is wider than that of a comparable open fixture rated bulb.

Figure 2:
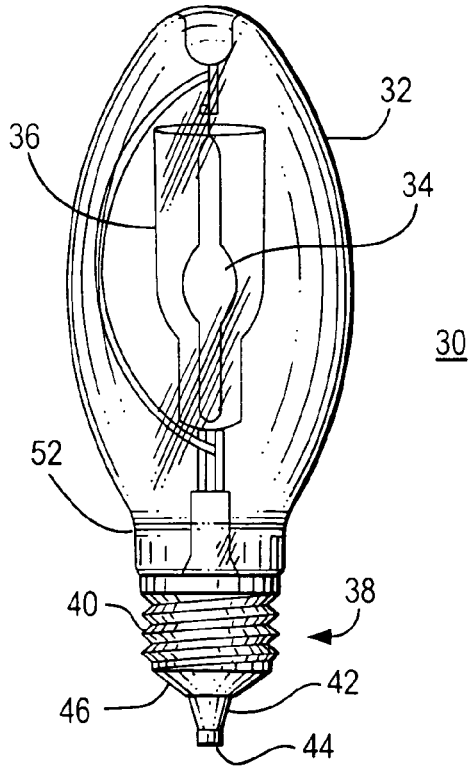
FIG. 2 PRIOR ART
FIG. 2 is an illustration of an open fixture rated lamp.

FIG. 2 is an illustration of a metal halide lamp 30 intended for use in an "open" fixture. The open fixture rated lamp may have a glass bulb 32 and quartz arc tube 34. The open fixture rated lamp may have a shroud 36. The shroud can be made of quartz and positioned about the arc tube 34. A metal screw base 38 has metal base threads 40 on its lower portion. An extension 42 of an insulating material can join metal button 44 to screw base 38 by an insulating flange 46. One side of the arc tube 34 can be connected to metal screw base 38 while the other side is connected to button 44. A lower portion 52 of the bulb 32 is narrower than that of a comparable closed fixture rated bulb, as described above.

Figure 3A:
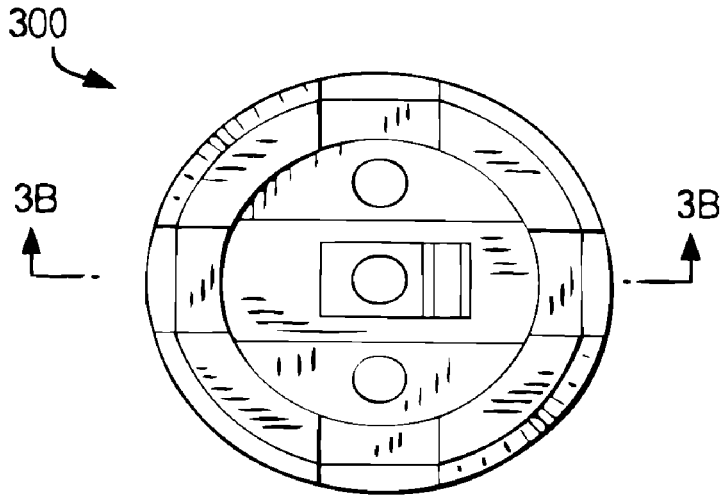
FIG. 3A PRIOR ART
FIGS. 3A-3B illustrate a prior art lamp holder adapter.
Figure 3B:
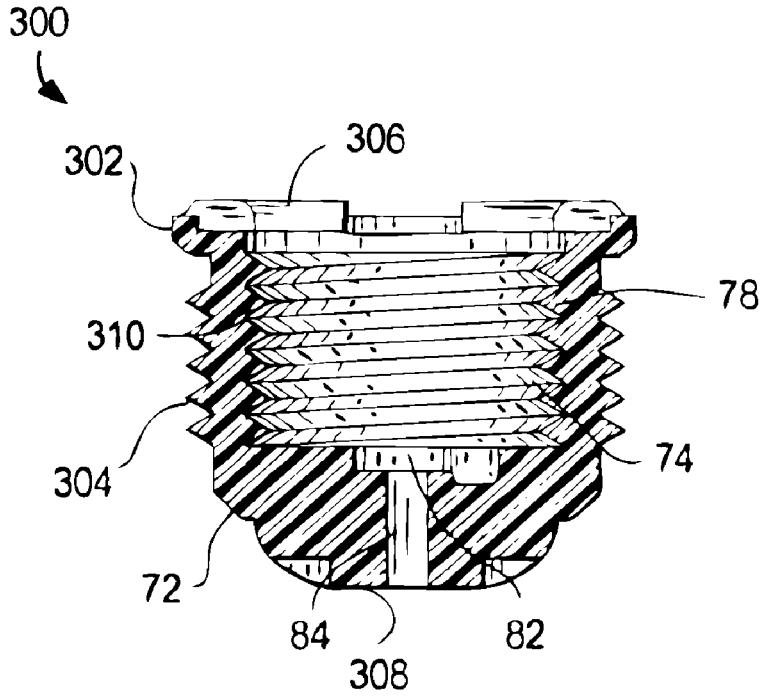
FIG. 3B PRIOR ART

FIGS. 3A-3B illustrate a top view and a front sectional view of a prior art lamp base adapter 300. The adapter can have a body 72, which defines an inner cavity 310 open at a first end 306 and substantially closed at a second end 308. The body 72 may be fabricated from an insulating material. A metal sleeve 74 can be mounted in the inner cavity 310 to form a socket. The metal sleeve 74 may be threaded 78 to receive base threads of a medium base threaded lamp as described above. Body 72 can have an aperture 82 under the bottom of the metal sleeve 74. Below aperture 82 may be a cavity 84 in body 72. An exterior metal sleeve 304 can be coupled to an exterior surface of the body 72. The exterior metal sleeve may be threaded, for example, to mate with a mogul threaded lamp holder. A flange 302 may be formed at the upper opening 306 of the body 72. However, both open fixture rated lamps and closed fixture rated lamps can be threaded into the metal sleeve 74 of the adapter.

Figure 4:
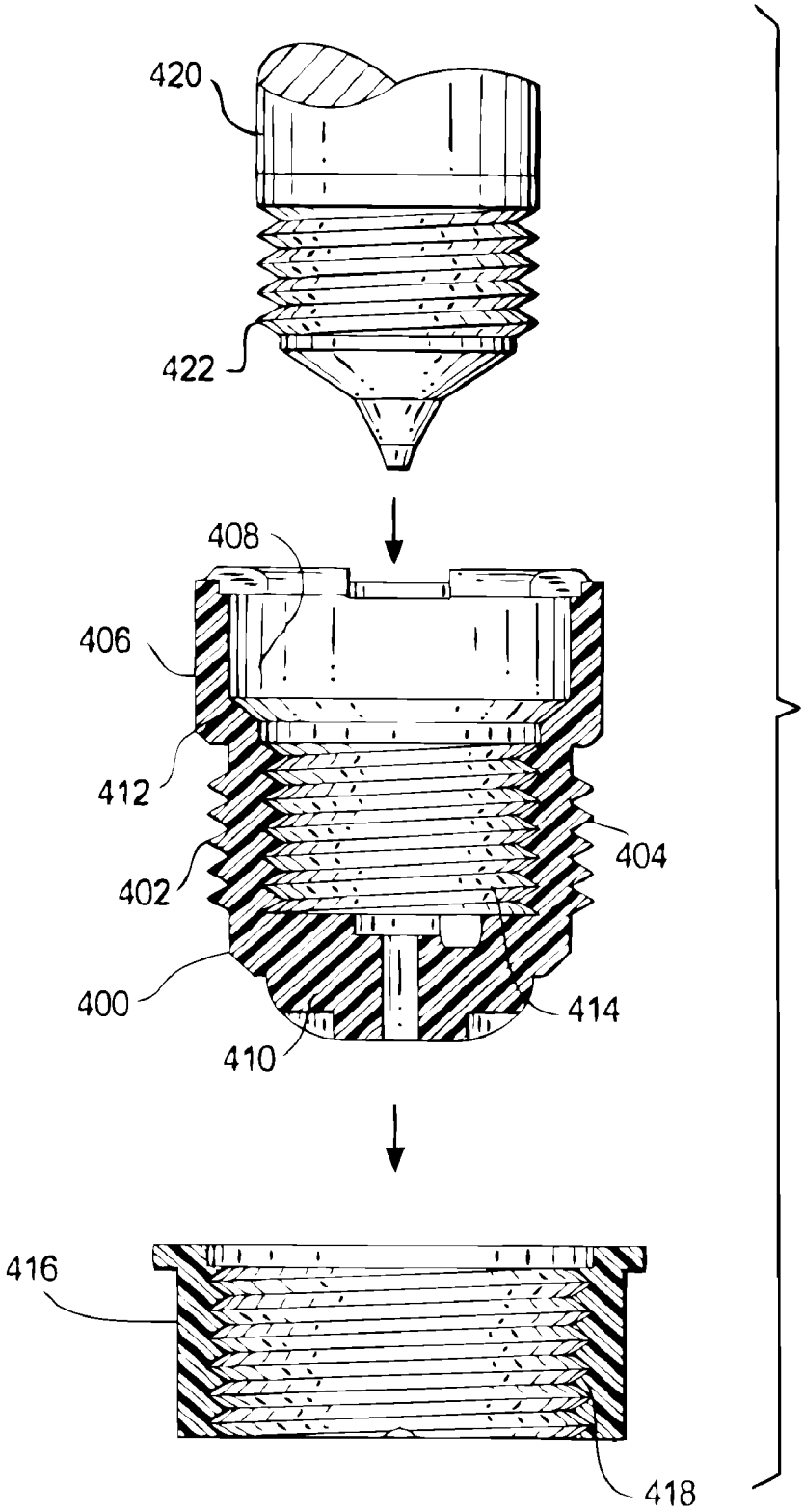
FIG. 4 is an illustration of an adapter in accordance with the presently disclosed techniques.

FIG. 4 illustrates a lamp adapter 400 in accordance with the present disclosure. The lamp adapter 400 has an elongated flange 406 having an opening 408 extending axially from a lamp adapter top portion 412 of the lamp adapter. The length of the elongated flange 406 is sized to prevent a 15 closed fixture rated lamp from completely threading into an internal threaded metal sleeve, or socket, 414. The length of the elongated flange 406 also is sized allow an open fixture rated lamp to completely thread into the internal threaded metal sleeve 414. Thus, the adapter 400 discriminates between the closed fixture and open fixture rated lamp by taking advantage of the differing geometries of the two lamp types. The adapter 400 can have an 20 exterior metal sleeve 402 coupled to an exterior surface a bottom portion 410. The exterior metal sleeve may be threaded 404, for example, to mate with a mogul threaded lamp holder 416, which is not part of the invention.

The lamp adapter 400 may be used to adapt an open fixture rated lamp having a medium base to an existing lamp holder 416 having a mogul base thread 418. The external metal sleeve 404 of the adapter may be threaded into a mogul threaded lamp holder 416. An open fixture rated lamp 420 having a medium base 422 can be threaded into the medium threaded socket 414 of the adapter. Electrical connections (not shown) from the lamp holder to the adapter may be made in any convenient manner. Thus, an existing lamp holder that is in an open fixture that previously only mated with mogul based lamps may be adapted to be relamped with metal halide lamps. The adapter also can prevent a user from inadvertently relamping with a closed fixture rated lamp and creating a potentially hazardous condition.

Figure 5A:
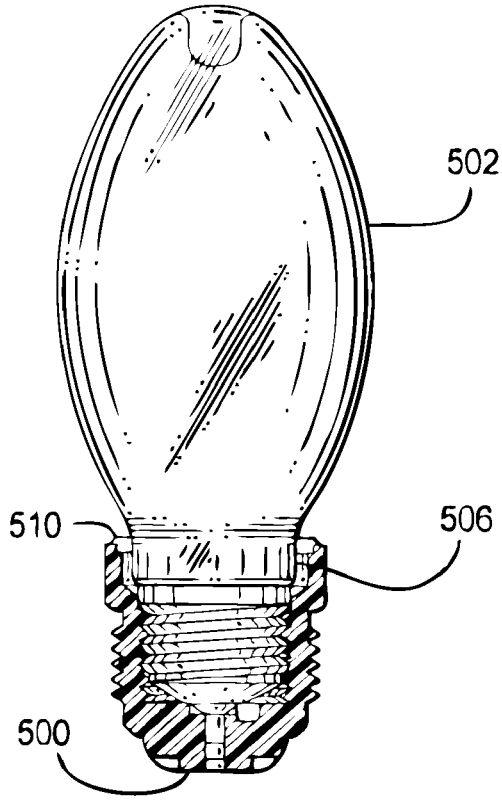
FIGS. 5A-5B illustrate an open fixture rated lamp and a closed fixture rated lamp being mated with the adapter of the present disclosure.
Figure 5B:
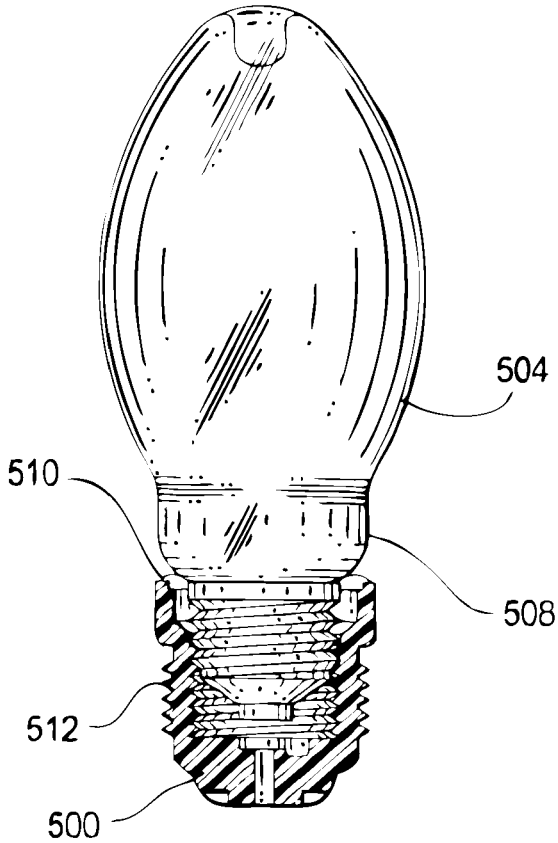

FIGS. 5A-5B illustrated an open fixture rated lamp 502 and a closed fixture rated lamp 504 used with an adapter 500 in accordance with the present disclosure. Referring to FIG. 5A, the open fixture rated lamp 502 has a narrower lower portion 506 than the lower portion 508 of the closed fixture rated lamp 504. An elongated flange top 510 does not interfere with threading of the open fixture rated lamp into the adapter 500, because the lamp lower portion 506 fits within the diameter of the elongated flange. In contrast, referring to FIG. 5B, the closed fixture rated lamp 504 has a wider lower portion 508 than the lower portion 506 of the open fixture rated lamp 502. The elongated flange top 510 interferes with threading of the closed fixture rated lamp into the adapter 500 because the lamp lower portion 506 contacts the elongated flange before the threads 512 of the closed fixture rated lamp can completely mate with the adapter.

While there have been shown and described and pointed out the fundamental features of the invention as applied to the preferred embodiment, as is presently contemplated for carrying them out, it will be understood that various omissions and substitutions and changes in the form and details of the device described and illustrated and in its operation may be made by those skilled in the art, without departing from the spirit of the invention.

What is claimed is:

1. A lamp adapter comprising:

a first portion extending longitudinally to threadably receive a medium base lamp; and an elongated second portion extending longitudinally from a first end of the first portion a length sufficient to prevent a closed fixture rated lamp from being completely threaded into the first portion;

a third portion;

wherein the first portion includes an open first end coupled to a third portion having a substantially closed second end and a hollow bore having a first section at the open first end and a second section at the substantially closed second end comprising a first threaded conductive sleeve in the hollow bore; and a second threaded conductive sleeve on an outside surface of the bottom portion.

2. The lamp adapter of claim 1, wherein the second portion extends axially from the first portion.

3. The lamp adapter of claim 2, wherein the second portion does not prevent a medium base of an open fixture rated lamp from completely threading into the first portion.

4. The lamp adapter of claim 1, wherein the first portion and the third portion are made of an insulating material.

5. A lamp adapter comprising:

a hollow lamp adapter having an open end;

a threaded internal sleeve mounted inside the lamp adapter to receive a lamp having a base of a first type;

an external sleeve mounted on the outside of the lamp adapter and having threads of a second type; and a flange extending axially from the open end, wherein the flange has a length to prevent a closed fixture rated lamp, when installed in the lamp adapter, from completely threading into the threaded internal sleeve and to enable an open fixture rated lamp, when installed in the lamp adapter, to completely thread into the threaded internal sleeve.

6. The lamp adapter of claim 5, wherein the lamp adapter is made of an insulating material.

7. The lamp adapter of claim 5, wherein the lamp base of the first type is a medium base and the lamp base of the second type is a mogul base.

8. A lamp adapter system for completing an electrical circuit with a medium base open fixture class of lamps having a threaded external sleeve about a base member and a central metal button contact mounted on the base member comprising:

a lamp adapter of insulating material having an open first end and a closed second end and a bore having an elongated first section at the open first end and a second section at the closed second end;

a metal sleeve in the second section; and internal threads on the metal sleeve disposed to receive the threaded external sleeve about the base member of an inserted lamp from the class of lamps wherein the class of lamps comprises an open fixture rated lamp having a medium base, wherein the first section extends a length from the first second section which allows the threaded external sleeve of only open fixture rated lamps having a medium base to be inserted therethrough and threaded into the metal sleeve in the second section, wherein said length of said first section is long enough to prevent a closed fixture rated lamp from being completely threaded into the second section.

9. A method of adapting a mogul base lamp holder to an open fixture medium base lamp comprising:

threading a first metal sleeve provided on an outer surface of a hollow lamp adapter to mate with a mogul base lamp holder, the hollow lamp adapter having an open first end to receive a base of a lamp;

threading a second metal sleeve provided in the hollow lamp adapter disposed to mate with said first metal sleeve;

extending a flange from the first end a length sufficient to allow a medium base of an open fixture rated lamp to be inserted therethrough and completely threaded into the second metal sleeve and to prevent the medium base of a closed fixture rated lamp to be inserted therethrough and completely threaded into the second sleeve.

10. The method of claim 9, wherein the flange extends axially from the first end.

* * * * *